US008956312B2

(12) United States Patent
Roll

(10) Patent No.: US 8,956,312 B2
(45) Date of Patent: Feb. 17, 2015

(54) APPARATUS FOR GENERATING SENSATIONS OF MOVEMENT AND FOR PHYSICAL REHABILITATION

(75) Inventor: Jean-Pierre Roll, Marseilles (FR)

(73) Assignees: Centre National de la Recherche Scientifique, Paris (FR); Universite de Provence, Marseille (FR)

( * ) Notice: Subject to any disclaimer, the term of this patent is extended or adjusted under 35 U.S.C. 154(b) by 1127 days.

(21) Appl. No.: 12/988,830

(22) PCT Filed: Apr. 22, 2009

(86) PCT No.: PCT/IB2009/005330

§ 371 (c)(1),
(2), (4) Date: Oct. 21, 2010

(87) PCT Pub. No.: WO2009/130579

PCT Pub. Date: Oct. 29, 2009

(65) Prior Publication Data

US 2011/0034253 A1 Feb. 10, 2011

(30) Foreign Application Priority Data

Apr. 22, 2008 (FR) ..... 08 02242

(51) Int. Cl.
*A61H 1/00* (2006.01)
*A61H 23/02* (2006.01)
*A61H 1/02* (2006.01)

(52) U.S. Cl.
CPC ..... *A61H 23/02* (2013.01); *A61H 1/02* (2013.01); *A61H 2201/165* (2013.01); *A61H 2201/5007* (2013.01)
USPC ..... 601/5; 601/23; 601/46; 128/898

(58) Field of Classification Search
USPC ..... 601/23, 30, 34, 46, 48, 49, 70, 74, 79, 601/81, 84, 104, 5; 607/48–50, 62; 600/384; 128/898
See application file for complete search history.

(56) References Cited

U.S. PATENT DOCUMENTS

| | | | | |
|---|---|---|---|---|
| 2004/0267331 | A1* | 12/2004 | Koeneman et al. | 607/49 |
| 2005/0137648 | A1 | 6/2005 | Cosendai et al. | |
| 2007/0073196 | A1* | 3/2007 | Tanaka et al. | 600/595 |
| 2008/0077192 | A1* | 3/2008 | Harry et al. | 607/48 |

FOREIGN PATENT DOCUMENTS

| | | |
|---|---|---|
| EP | 1 201 266 | 5/2002 |
| EP | 1 798 635 | 6/2007 |
| WO | WO 2005/105203 | 11/2005 |

* cited by examiner

*Primary Examiner* — Quang D Thanh
(74) *Attorney, Agent, or Firm* — Harness, Dickey & Pierce, P.L.C.

(57) ABSTRACT

The appliance designed to allow a living being to perceive sensations of virtual movements of part of his body comprises a control unit in which is stored a table containing a first plurality of basic excitation signals, a second plurality of macro-motifs each formed by a third plurality proper of the basic signals, a sequencer reading the macro-motifs in order to emit a second plurality of corresponding commands for excitation, each time, of a third plurality proper of vibrators selected from among a first plurality of vibrators carried by a coupling support in predetermined respective zones of the part of the body, the excitation of the third plurality proper of vibrators by the second plurality of commands being intended to mechanically stimulate elements of the body, to provoke the creation of bioelectrical signals in the living being, allowing him to perceive sensations of a given virtual movement.

19 Claims, 5 Drawing Sheets

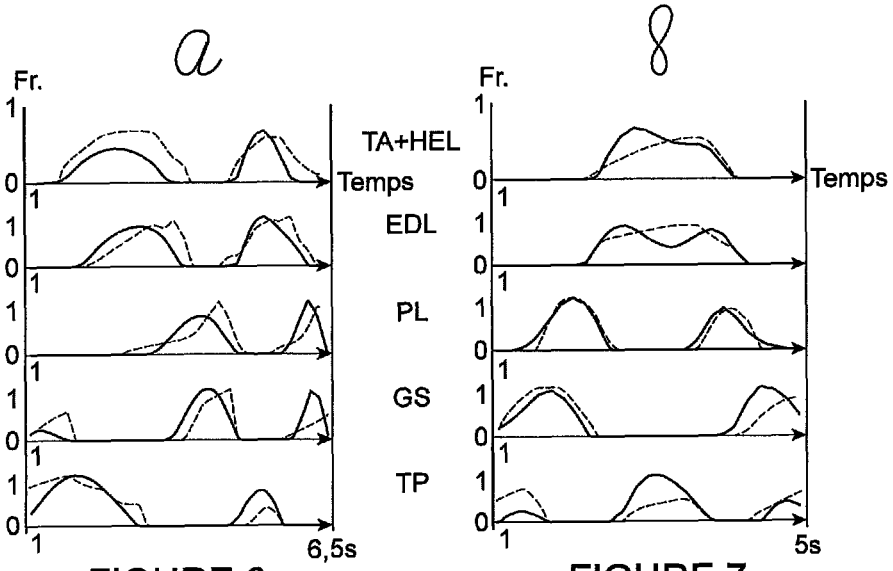
FIGURE 6
FIGURE 7
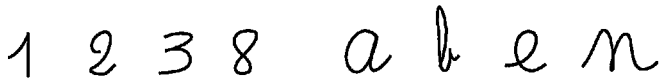
FIGURE 8A
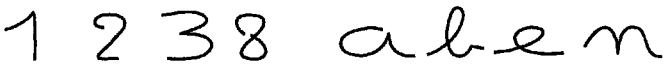
FIGURE 8B
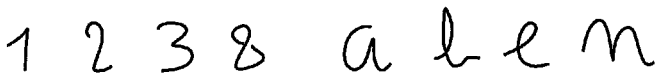
FIGURE 8C
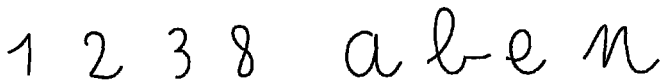
FIGURE 8D

APPARATUS FOR GENERATING SENSATIONS OF MOVEMENT AND FOR PHYSICAL REHABILITATION

CROSS-REFERENCE TO RELATED APPLICATIONS

This application is a National Phase Entry of International Application No. PCT/IB2009/005330, filed on Apr. 22, 2009, which claims priority to French Application 0802242, filed on Apr. 22, 2008, both of which are incorporated by reference herein.

BACKGROUND OF THE INVENTION

The present invention relates to apparatus capable of generating sensations as perceived by the brain during the performance of a movement affecting part or all of the body of a subject, while this same part of body is not actually being affected by any movement. The present invention concerns, inter alia, physical rehabilitation of persons, even certain animals, a damaged limb, or any other body part, part of which is immobilized by a corset. The present invention also relates to education and rehabilitation on functional movements that the brain no longer knows how to perform, or performs imperfectly, as a result of injury which is accidental or resulting from an illness, or due to a malformation.

The present invention also relates to the learning by an individual or an animal, of a body movement or gesture which has a specific purpose. It also relates to the addition to an individual's or an animal's received perception of a situation or a virtual event, of an additional type of sensory information. The term "virtual reality" is commonly used to describe such a confrontation of a subject with images, sounds and other types of sensory information, providing a descriptive representation of the situation or the virtual event. The invention is capable of causing a subject to perceive sensations corresponding to those of movement, whether or not the subject is performing these movements, which in effect constitutes additional sensory information for perception of virtual reality, and thus an enrichment of this perception.

A person with a broken upper or lower limb, or injured ligament, is usually fitted with a rigid corset that immobilizes the affected limb, such as a joint. When the corset is removed after a few weeks the relevant joint muscles are incapable of operating the movements they allowed prior to immobilization of the joint. This is due, firstly, to the fact that the muscles were injured or unused and, secondly, the fact that the brain has lost some of its ability to manage movements resulting from these muscles being brought into play. Indeed, many studies have shown that certain brain networks assigned to this task are progressively reassigned to other tasks if they fail to receive nerve messages sent by the skin and muscles when working. Physiological receptors located notably in the skin and muscles are responsible for issuing bioelectric messages to the brain. Specifically, some of these receptors are between muscle fibers and are located so as to be sensitive to the extension of the muscle. These messages are "reports" that describe the detailed movement of every muscle, so the brain can, in turn, have a representation of an action and control the muscles to eventually correct their movement and also to guide further movement in the desired direction.

Writing is a good example of such a feedback loop. The writer is simultaneously contracting or extending a number of muscles of the hand and wrist, all these elementary movements requiring, of course, to be perfectly coordinated. The brain senses, notably, messages issued by each muscle involved and the skin in case of extension, and it makes a synthesis of this information to determine what was, until then, the movement made, ie the path followed, in the case of writing.

SUMMARY OF THE INVENTION

The present invention sets out in particular to reduce the need for physical rehabilitation when part of the body of a living being, especially a human being, has been immobilized. It can also help correct a deficiency or inability to perform movements, whether these result from an injury or malformation, of the musculoskeletal system and nervous system. To this end, the invention firstly provides apparatus, especially for physical rehabilitation of part of the body of a living being, comprising a control unit comprising a table held in memory containing a first plurality of elementary excitation signals being elements making up a second plurality of macro-patterns each consisting of a third specific plurality of said elementary signals, the control unit including a sequencer adapted to read the macro-patterns and issue a said second plurality of corresponding command excitations for a said third specific plurality of vibrators selected, on each occasion, from among a said first plurality of vibrators carried by a coupling support in respective predetermined areas of the part of the body.

Each macro-pattern consists of a set of elementary patterns each representing the form or shape of a signal controlling the movement of one of the vibrators, that is to say a mechanical means for exciting a point on the skin and/or any physiological receptor structure located below such as a tendon or muscle. Macro-patterns are determined from recordings made previously in humans or are synthesized macro-patterns, prepared by composition of elementary patterns, the shape of each having been optimized to emulate a determined movement.

Each of the vibrators, applied to the skin, will thus stimulate a set of physiological receptors, that is to say a particular point for example of a tendon associated with a damaged joint, this stimulation being performed with a direction, intensity and frequency constituting an equivalent number of parameters in selecting each elementary pattern memorized. Variation over time of this stimulation and the multiplication of points of stimulation constitute many of physiological receptor stimulations. It is thus the combination in space and time of these simultaneous stimuli, that is to say, applied at various points on the skin to excite the underlying tissue, which will supply the brain at any moment, with a "neuro-sensory flow" type dataset, that is to say that the brain receives sensory messages from the various tissues excited that depend on the amplitude and frequency of the various vibrations, which constitute an emulation of the effective extension of the immobilized muscle, of the stretching of the skin and of the perceived displacement of the limb. Neural networks of the brain areas under consideration will regularly receive such information, at the rhythm set by the sequencer, and the thus ensured continuation of the corresponding processing task will make that these neural networks will remain, at least in large part, assigned to the processing of sensory flow originating from the muscles under consideration, since the immobilization of these will be masked in this way.

After healing of the muscle or joint and its consequent release, rehabilitation will only essentially be mechanical, that is to say focus almost exclusively on recovery of the full force of the muscle, since the brain will have preserved the corresponding network for representing and managing movement. As mentioned above, each macro-pattern may include data specifying a modulation of amplitude and/or frequency of movement of the vibrator over a predetermined period of excitation. Preferably, the sequencer is mechanically independent of the coupling support, and is connected to the vibrator by a data link. The vibrators are for example controlled through a respective transponder. We can thus equip an injured person with a sort of harness keeping the vibrators at the desired location, the problem of immobilization being handled by a sleeve or other component external to the apparatus of the invention.

In general, the only elements necessarily worn by the patient are the vibrators with their coupling support. As against this the macro-patterns can be perfectly well stored in a common server shared by several such apparatuses. The common server can contain a complete library of all types of macro-patterns, that is to say for all types of limbs or other body parts that may need treatment. For the treatment of a specific limb, the sequencer will choose the appropriate set of macro-patterns.

The link for providing the macro-pattern to vibrators may be operated by cellular telephone or data transmission network link circuits. It will be recalled that a mobile phone includes a port for data exchange, which in this example, can be connected to a logic unit for management of data exchange and control of the vibrators. One can also consider a link such as the Internet, preferably with a wireless terminal link, that is to say of the WiFi or equivalent type, in order to permanently maintain the ambulatory aspect. A person in ambulatory care at his home, for example, can receive data messages containing the appropriate sequences of macro-patterns. The above management logic, forming a sequencer and a local transmitted bit format and bit rate adapter, will then store the data bits reflecting the sequences of macro-patterns received over the high-speed network, and will restitute, in non-real-time, these data in a desired format compatible with the vibrators, and at the desired speed.

The apparatus of the invention described above may be provided to limit the need for physical rehabilitation after immobilization of all or part of the body, for example following a fracture, an injury or disease. It can also be provided to lessen the consequences of prolonged bed rest, keeping neuronal circuits active for processing messages descriptive of fundamental movement, such as for maintaining a natural posture or for locomotion. Moreover, it was found that implementing the apparatus according to the invention on a subject so as to give his or her brain messages descriptive of the same movement repeatedly, is capable of gradually inducing performance by the subject of the said movement. This property can be used to enhance or correct the repertoire of gestural knowledge recorded by the brain and make it possible to learn an unknown gesture, or to perfect a gesture which is imperfectly performed.

The apparatus of the invention can thus be provided as a means for physical rehabilitation by providing descriptive messages to the brain of a movement that the brain does not know or can no longer perform, or only performs imperfectly. Such situations can result from damage due to sickness or accident, or result from a malformation. Such neurological damage, whether accidental or degenerative, can affect the central or peripheral nervous systems. This apparatus can in particular be adapted to deliver the messages that match descriptions of the movements of locomotion. In this particular case, having identified the muscles involved, the vibrators are held in position by a suitable coupling support adapted to transmit stimuli to the appropriate physiological receptors according to the excitation signals provided by the reading of macro-patterns specific to walking. Another application of the apparatus of the invention consists in re-educating how to maintain a particular posture or body position in a living being, such as standing upright in human beings.

The apparatus of the invention can also be provided to allow the learning or fine tuning of complex body movements, including those requiring precision. We can cite for example writing, body movements associated with a sporting activity, the serve in tennis or the golf swing, or with a professional or artistic activity. Such learning or fine tuning may also apply to the performance of body movements under conditions different to the usual conditions of a subject. These include the conditions corresponding to free fall or weightlessness and microgravity, increased gravity and acceleration.

Such apparatus can also be used in the framework of virtual reality. Indeed, the mobilization of a greater number of sensory channels contributes to improving the quality of perception of virtual reality experienced by the subject, human or animal. As an addition to the usual channels such as vision, brought into play by the picture, hearing brought into play by sound and sometimes touch through various pieces of mechanical equipment, the apparatus of the invention can be used to add sensations of movement, and thereby enrich the description of the situation corresponding to the virtual reality which the subject is facing.

The apparatus of the invention can be designed to be part of a production system for virtual reality. Among such systems, we can notably mention video game consoles and simulators of all kinds. Among the latter, we can mention flight simulators, simulators for driving all kinds of machinery, for industrial process control, simulations of extreme conditions, such as weightlessness and ultragravity, simulators of complex and very precise movements such as in surgery. The virtual representation production system including apparatus of the invention which is functionally integrated therein, combines calls on the user's sensory channels with sensations of perception of virtual movements. Indeed, this system will supply messages to the brain carrying sensory information corresponding to movements of the body represented by the virtual reality generated by the system, and with which the subject is confronted, giving the impression of performance of these movements whether or not the subject is actually performing or not the said movements. This is achieved through a recording and analysis of movements to which it is desired to give the impression of performance and identification of the muscles brought into play by them. The macro-patterns specific to each specific movement are used to take control, every time such a movement is the result of the virtual situation shown, of the vibrators being held in position appropriately so that they stimulate, when asked to, the tendons of the muscles involved by this movement.

The apparatus of the invention includes means for holding the vibrators in contact with the skin at the desired location, or a coupling support. It is possible to adopt many embodiments for putting into practice the function of this coupling support, which depend to a great degree on the use made of the apparatus. Practical embodiments can take such forms as a harness, a body suit, a full or partial garment, with a material and design appropriate to the use. A harness may for example take the form of a set of straps fitted with adjustment means to adjust the position of the vibrators, and the contact characteristics of each vibrator with the skin. In addition, the coupling support may perform one or more other functions exhibiting synergy with the particular use made of the apparatus of the invention. Notably, the coupling support can operate, functionally, restraint or immobilization of a body part corresponding partly at least to the part subject to stimuli.

The invention thus relates generally to apparatus for generation of bioelectric signals, providing a living being with sensations corresponding to the performance of a given movement of a body part (1) even if this movement is not performed, comprising:

a table of elementary excitation signal, a control unit including a sequencer, vibrators carried by a coupling support maintaining each of them in a predetermined position relative to body elements of the body part, in which, for each given movement, each vibrator can receive an elementary excitation signal that stimulates mechanically body elements of the body part to cause bioelectric signals to be issued, all elementary excitation signals of the various vibrators constituting a macro-pattern, these elementary signals being chosen to form a specific macro-pattern characteristic of the movement under consideration, this macro-pattern read by the sequencer supplying said vibrators with the elementary excitation signals capable of causing the creation of bioelectric signals in the living being causing him or her to perceive the sensations of performance of said movement.

The invention also relates to a method for making out of macro-patterns for exciting the apparatus according to the invention, in which method tests are performed on at least one subject, by applying stimuli in the form of vibrations resulting from a first macro-pattern determined in advance, for a body part under consideration, simulating, virtually, a determined movement, the subject indicating his or her perception of the virtual movement thus evoked by the stimuli, and, by successive iterations, with change of the parameters of the first macro-pattern, determining the final values of said parameters corresponding to a satisfactory emulation of the real movement simulated, and having repeated the previous cycle of steps a desired number of times to obtain the desired number of macro-patterns, the parameters for these are stored in the said table.

It may in particular be determined what muscles exist in the body part in question and successive cycles continue to be executed until a sufficient number of macro-patterns have been built up so that each of said muscles is handled by at least one macro-pattern. The invention also relates to a use of the apparatus of the invention, in which the apparatus is functionally integrated with a video game console in order to emulate, for the user, movements to an avatar of the user displayed on a screen.

The user can thus perceive the movement of his or her avatar and possibly voluntary movements the user performs or blows received. In a sophisticated usage, the user wields a three-directional (3D) accelerometer to control the movements of his or her avatar, that is to say he or she controls the game by their own 3D movement, in direction and intensity, and perceives it or only the avatar's contact with the environment (impact with a wall, a combat fight) using the apparatus of the invention. The user's perception of events displayed on screen is thus simultaneously visual, tactile and accompanied by motor sensations, with sensations of local acceleration, that is to say movement. It will therefore be seen that these two parallel and complementary channels for perceiving the environment provide a way of intensely immersing the user in this augmented visual environment. More generally, the invention relates to apparatuses and methods as defined in the claims.

BRIEF DESCRIPTION OF THE DRAWINGS

The invention will be better understood from the following description of an embodiment of an orthotic apparatus implementing the method of the invention, with reference to the accompanying drawings in which:

FIGS. 6 and 7 each show five temporal patterns of signals from different muscles, respectively, when we draw the letter "a" and the digit 8, on each occasion with a natural signal detected and the same signal after processing; and FIG. 8, consisting of FIGS. 8A, 8B, 8C and 8D, respectively comprises four lines of the same four digits and the same four elementary letters, showing the perception gained therefrom when implementing macro-patterns.

DETAILED DESCRIPTION OF PREFERRED EMBODIMENTS

Figure 1A:
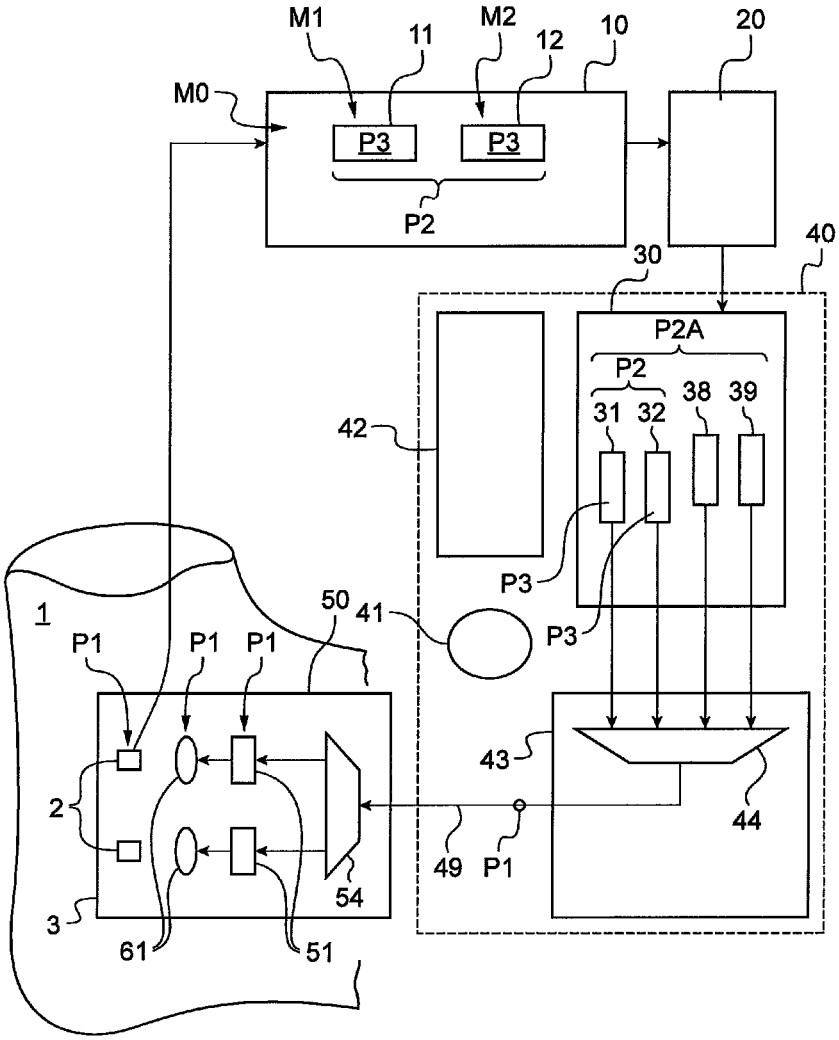
FIG. 1 is formed of FIG. 1A, a block diagram illustrating the context of the invention in the form of a loop for transmitting information between a tendon associated with the orthosis and the brain, and a FIG. 1B illustrates more precisely the shape of the orthesis.
Figure 1B:
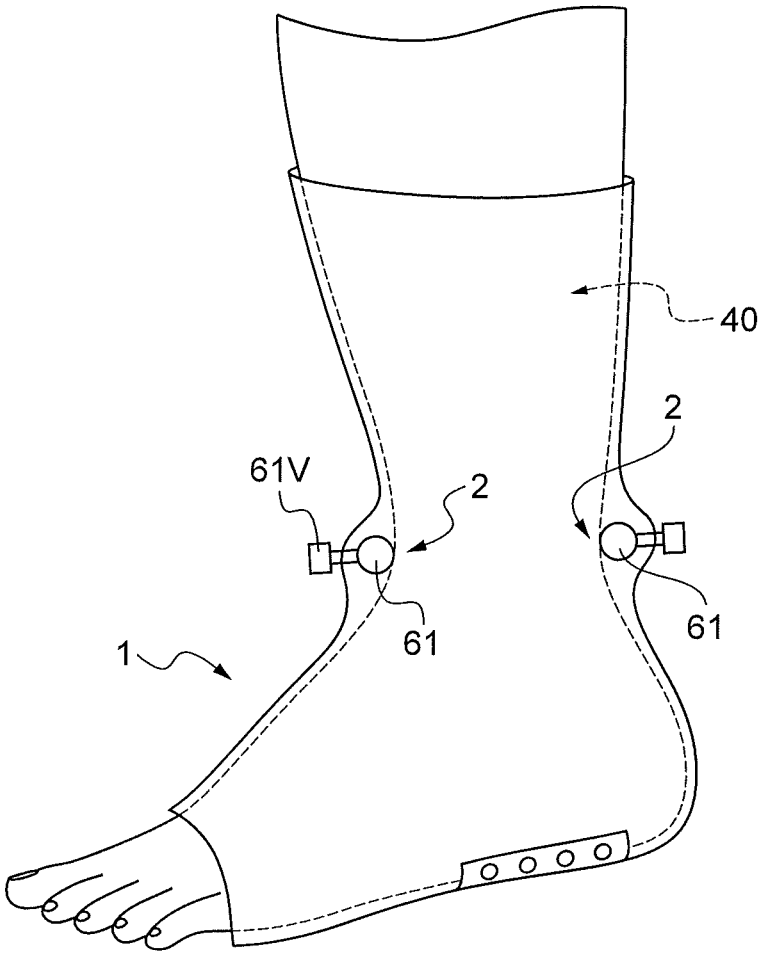

FIG. 1A is a diagrammatic view illustrating the context of the invention. The muscles of the foot 1 in a movement of a person, seen here from the right, and more precisely tendons 2 conventionally issued, to the brain, elementary signals signifying the movement in progress, that is to say, the trajectory and speed of the foot 1, in the form of its overall advancing movement along with its rotational movements. FIG. 1B shows, seen from the left, in more detail the shape of the orthesis, which closely outer housing the foot and lower calf.

It should be remembered that, conventionally, the movement of any object can be defined by reference to six types of movement, namely three translations along respectively, three orthogonal axes, such as a vertical axis and two horizontal axes defining a front/back direction and a lateral direction, and three orthogonal axes of rotation. Movement was caused by voluntary control from the brain or by reflex action. The signals received back from the brain are a report of the movement performed, so that the brain may if needs be send a correction command for correcting a movement that it considers inappropriate or to follow up with a continuation of the movement. This is especially important to synchronize walking. The brain is well accustomed to handle such signals. However, when there is immobilization of the limb, following a sprain, fracture or other, the brain no longer receives such signals and neural networks which used to process them are gradually diverted to other tasks.

Such elementary "movement" signals received by the brain have been picked up by electrodes inserted in the nerve, close to sensory fibers originating from physiological receptors, and stored in a database 10. The total number of tendons 2 defines in this way a first plurality, of size P1, of such elementary signals, and any particular movement M0, from a second plurality P2 of possible movements, corresponds to a proper subset constituting a particular set made up by a third plurality P3 of elementary signals belonging to the first plurality P1. Each third plurality P3 is size-specific to the movement M0 under consideration from the second plurality P2, since it consists of those of the elementary signals that are specific to this movement M0. In this present description, reference numerals to a plurality P1, P2 or P3, each of which covers different types of elements, means only the number or size of the plurality, while the nature or type of the elements is indicated by the terms associated with the reference.

By way of numerical explanation only, we have for example a first plurality P1 of 5 tendons 2 to monitor (only tendons 22 being shown), that is to say, a first plurality of elementary signals P1 to acquire through 5 acquisition channels. A first determined movement M1, from the second plurality P2 of movements, for example reflecting 10 movements M0, will for example cause a reaction on a said third plurality P3 of channels that will for example constitute channels ranging from 1 to 4, while a second movement M2 will cause a reaction on another third plurality of channels P3 formed by channels ranging from 3 to 5. This shows that the third pluralities P3 of channels, and therefore also of elementary signals are of disparate sizes, here of respective sizes 4 and 3 channels. Each one of the P2 third plurality P3 of elementary signals forms a dataset, of size P3 (number of elementary signals) specific to the movement in question M0. The second plurality of movements P2 can be much larger than the first plurality of elementary signals P1 since the various (P3) datasets of the second plurality P2 of movements are each formed by specific combinations and of sizes P3 which are mutually different, of said elementary signals encompassed in the first plurality P1.

To identify each of these elementary signals, there have been identified during testing, a first set of movement types, as a number of relevant signals forming the first plurality P1. For each movement M0, that is to say every third plurality of elementary signals P3, a mean for each one of the elementary signals has been determined that is to say, smoothing out of differences due to various causes, such as size or morphology of the subject has been determined. Reference numerals 11 and 12 thus designate, each one for a particular movement M0 among the P2 movements, a said dataset containing a third plurality P3 of such elementary signals, the two datasets 11, 12 corresponding respectively to two representative or "standardized" movements, M1 and M2, determining the size of the second plurality P2, which is then P2=2, to simplify this presentation. Obviously, this is a simplified representation, since a much larger second plurality P2 of datasets had been established containing a third plurality P3 of movement signals M0. Each third plurality P3 of signals of a dataset 11 or 12 consequently represents all elementary signals sent by different tendons 2 during the movement M0 under consideration. As indicated, various third pluralities P3 are generally of different respective sizes, that is to say that every movement M0 involves a number of tendons 2 specific to it, for example on each occasion from three to five out of a greater number (P1) of existing tendons 2, but for which the other tendons 2 are not relevant to the movement M0 under consideration. In short, this ascending branch, to the brain, implements a transducer function, with a passage from the field of mechanics, specifically kinematics, that is to say an area of "action" to the field of bio-electric signals, specifically the field of information or knowledge, with the analysis of signals by the brain.

One basic idea was to examine if one could perform the reverse transformation, starting out from the database 10 which is a descriptive library of bio-electric responses to the various (P2) movements M0. The value of this would be the possibility of creating these same second pluralities P2 each of P3 signals, giving sensory feedback to the brain when the body part in question, here the foot 1, is immobilized by a coupling support 3 here in the form of a sensory feedback orthosis constituting a corset applied to a foot, wounded, in order to thereby preserve the corresponding signal analysis activity at the brain. To do this, a descending branch is defined, from the database 10 to the foot 1, an upstream section of which is purely electronic and a downstream section of which is of an electric-mechanical type for transforming control electrical signals into mechanical stimuli at the tendons 2. The database 10 controls a transcoder 20 which itself controls writing into a memory 30 of a said second plurality P2 of macro-patterns 31, 32, each containing a said third plurality P3 of elementary signals, macro-patterns 31, 32 being defined to have a bijective relationship with the respective datasets 11 and 12 of each movement M0.

The memory 30 is part of a control unit 40 managed by a central unit 42 driven by a timebase 41 and associated with a sequencer 43 connected to read macro-patterns memory 30. Each macro-pattern, among the second plurality P2 of macro-patterns 31, 32 each containing P3 electronic control patterns, can thus control via a link 49 having a said first plurality of channels P1, a said third plurality P3, specific to it, of transducers 51, or transponders, chosen from a said first plurality P1 of transducers 51. The first plurality P1 of transducers 51 controls a said first plurality P1 of respective associated vibrators 61 applied in various predetermined positions on the muscles of the foot 1 and in particular on the P1 respective tendons 2. In other terms, the fact of a dividing into first P1, second P2 and third P3 pluralities this downstream section of the descending branch, electronic and mechanical, is the image of what exists on the ascending branch, through the body. FIG. 1B shows that the vibrators 61 are located under the outer housing forming the orthesis and applied to the associated tendon 2 under a coupling adjustments screw 61V.

The first plurality P1 of pairs of transducers 51 and vibrators 61 is thus of a sufficient number allowing all the types of elementary signals that are in the database 10 to be produced. Note however that there may be even more transducers 51 and vibrators 61, that is to say a fourth plurality greater in number than the first plurality P1, if, for example, it is planned to combine vibrations from several vibrators 61 for obtaining a composite vibration in an optimal composite direction, reflecting the direction of maximum sensitivity of a tendon 2, that is to say to which it supplies in response, to the brain, an elementary signal of maximum amplitude. Specifically, macro-pattern 31 or 32 selected to emulate, vis-à-vis the brain, a movement M1 or M2 forming part of the second plurality P2, will control one of the second pluralities P2 forming part of the first plurality P1 of transducers 51, in order to mechanically stimulate those ones of the tendons 2, or other parts of the body, which normally generate the elementary electrical signals in response to the actual movement M1 or M2 under consideration.

In feedback system terms, the loop formed by the ascending branch, from the tendons 2 to the database 10, and the return descending branch, has a unity gain, that is to say that the descending branch is capable of producing, and delivering to the tendons 2, signals of a mechanical nature which cause, in reaction thereto, the generation of elementary biological and electrical signals, and, in addition, the descending branch is arranged so that the elementary electrical signals, induced by reaction at the tendons 2, are substantially identical to the original elementary signals, ie those which, after digital encoding, form datasets 11 or 12, which were the starting point, in the database 10 for producing the stimuli. After an initial phase of adjustment of the descending branch to set the loop with unity gain, and, having built up a said database 10, the second plurality P2 of datasets 11, 12 of which have been deemed sufficient, only the descending branch is subsequently exploited in order to emulate virtual movements. We may in particular think of video games, where the player's brain could perceive sensations of movement that would be purely virtual. In this case, the coupling support 3 would no longer be a corset for immobilising a limb, and it would only retain its holding function of keeping all the vibrators 61 at a predetermined position for coupling at any desired position on the body.

An important point to note is that, having memorized the first plurality of elementary signals P1, the majority in multiple copies distributed in the various, P2, datasets 11, 12 for P2 movements actually observed, we now have a "pool" or library of elementary components of movement, so that we can foresee to increase, in memory 30, the size of the second plurality P2 of macro-patterns 31, 32 and others, that is to say to build the number up to a second larger plurality P2A, by adding new macro-patterns 38, 39 capable of causing the emulation of virtual movements, which were never observed while database 10 was being formed. The above virtual movements may be "conventional", natural movements, such as movement of a limb or be movements which are out of the ordinary, for example corresponding to a supernatural force or extra-natural such as hallucination-like or corresponding to an unusual position, such a position adopted during a swimming exercise or a skydive from a plane. We thus can emulate the movements desired in a video game. The fine tuning needed to define each supplementary macro-pattern 38, 39 may be achieved through iterative trial, by applying the extra macro-pattern 38 or 39 to a subject and collecting the opinion of the person concerned about the feelings he or she perceives.

Datasets 11 and 12 each represents variations over time of the corresponding signals, that is to say their instantaneous amplitude constituting a temporal pattern for control of the vibrators 61, through the transducers 51. The waveform reflecting how instantaneous amplitude evolves over time, can be defined in memory 30 by a series of samples evenly spaced over time, for example every 5 milliseconds, equivalent to 200 Hz. Another way to represent the shape of the signal for a pattern is to consider that it has a DC component, which can vary at a certain speed, which is superimposed on an AC component, that is to say, to of faster varying amplitude and with an instantaneous frequency that can change, possibly with phase drift. We can then define the signal by data specifying how the DC and AC components of the pattern change over time. The signals generated by the tendons 2 are thus coded to be exploited digitally. Macro-patterns 31, 32 will each be established from the dataset 11 or 12, their source, with intermediate transcoding, by the transcoder 20, for adapting them to the specific characteristics of the vibrators 61, that is to say, their sensitivity or mechanical response to electrical commands, and in particular their frequency operating range and response curve, or sensitivity, depending on frequency, just like their response phase shift with frequency.

In general, the parameters to take into account in the overall loop are:

Ascending Branch:

Sensitivity of the reaction of tendons 2 to a movement, and this according to its magnitude, direction and speed, determining the form of the elementary bio-electric signal sent.

Sensitivity or reception in the brain.

Digitizing mode the elementary signal received in the database 10.

Descending Branch:

Transduction function of transcoder 20.

Encoding mode in memory 30, of signals from the transcoder 20 to form the macro-patterns 31, 32.

Transformation of macro-pattern digital signals 31, 32 into analog signals transmitted on link 49.

Sensitivity of the transducers 51, in amplitude, frequency and phase.

Response sensitivity of the vibrators 61, as regards amplitude, frequency and phase.

Efficiency of the coupling between the vibrators 61 and the area of skin facing it, and therefore with the tendon 2 under consideration.

The development of the invention has made it possible to identify a specific group of a said first plurality P1 of said elementary loops, each relating to a said elementary signal and having unity gain, so as to accurately emulate a movement M0 initially observed or even a new movement. Each macro-pattern 31, 32 thus comprises data specifying a modulation of amplitude and/or frequency of movement of the vibrator 61 over a predetermined period of excitation.

The memory 30 and associated sequencer 43 can be mechanically independent of coupling support 3, and connected to transducers 51 by the data link 49 which may include a bundle of a first plurality P1 of conductors each controlling a particular transducer 51. It can however be provided for data link type 49 to be a wireless link, for example a radio link. In such cases, preferably, a common channel for data transmission on a carrier frequency is established, and the third plurality P3 of signals in each macro-pattern 31, 32 is transmitted by time-division multiplexing, that is to say in the form of successive data messages sent each to a particular transducer 51 by a multiplexer 44. Upon reception in the orthesis 3, the messages are delivered to the intended destination above (51) through a demultiplexer 54, acting as a channel selector or router able to reach the desired transducer from among the P1 transducers 51 which are possible recipients. If the signals received are digital, a digital/analog converter is associated with demultiplexer 54 to convert them into analog signals suitable for directly controlling the transducers 51. Transmission of the P3 patterns of each of the P2 macro-patterns 31, 32 may however also be done in a purely analog fashion, with an appropriate decoder at the input to link 49. It may also be provided to store the macro-patterns 31, 32 in analog form.

In particular it may be provided for the memory 30 containing the macro-patterns 31, 32 and the sequencer 43 to be housed in a remote server capable of serving a whole population of orthesis 3 of so-equipped vibrators 61. In such cases, the connection 49 is of a wireline or radio, cellular or satellite telephone type, and the transducers 51 are then controlled by telephone station circuits, for example cellular. Specifically, it can be provided for the orthesis 3 to include to a sort of pouch for attaching such a mobile station and the data port that such station conventionally includes is used for restituting, on physical signal lines, the signals for the macro-pattern 31, 32 received by radio. The above explanation regarding demultiplexing also applies to this case.

It can be conceived that such an organization for data transmission from a central server allows offering any desired changes in the variety of P2 macro-patterns 31, 32, to increase the size of P2. In the case of an application to a video game, one can offer a games service in real time, on demand, that is to say, after request to the server. Provision can also be made for the mobile station to receive and store the entire contents of the memory 30 for the macro-patterns 31, 32, in order to then play locally, thus without maintaining the data download telephone connection above. In another variant, it is a computer network for data transmission, such as the Internet, which replaces the telephone network.

For the making out of the macro-patterns 31, 32, tests are performed on at least one subject,

- by applying stimuli in the form of vibrations of a first macro-pattern 31 determined in advance, for a limb (1) under consideration, simulating, virtually, a determined movement,
- the subject indicates his or her perception of virtual movement thus evoked by stimuli,
- and, by successive iterations, by changing the parameters of the first macro-pattern 31, the final values of said parameters are determined corresponding to a satisfactory emulation of the real movement simulated, and
- having repeated the previous cycle of steps a desired number of times to obtain the desired number of macro-patterns 31, 32, the parameters of these are stored to form a table constituted by the memory 30.

The above parameters thus determine the temporal shape of each temporal pattern, that is to say that each parameter can be represented, as mentioned above, by amplitude samples, possibly limited in number and supplemented by information on frequency and phase. In particular, it is determined which muscles exist in the member concerned and successive cycles continue to be implemented until a sufficient number of macro-patterns 31, 32 are developed in order for each of said muscles to be handled by at least one of the macro-patterns 31, 32.

Additional indications, outlining details of the tests performed, will now be provided. The task in hand was to develop the macro-patterns 31, 32 and 38, 39, that is to say, to determine the residual errors between the sensation of movement induced in subjects and a real movement that each macro-pattern represented as well as possible. The following abbreviations are used for tendons 2 of the ankle: TA=tibialis anterior, EHL=extensor hallucis longus, EDL=extensor digitorum longus, PL peroneus lateralis=, GS=gastroenemius soleus, TP=tibialis posterior, and FIG. 2C for the wrist, involves the extensor, abductor, flexor and adductor.

Figure 2A:
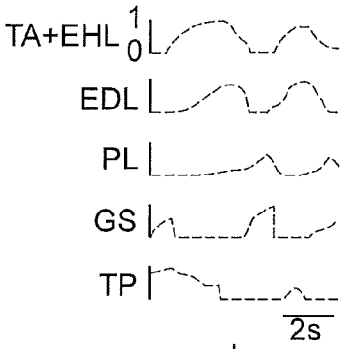
FIG. 2, consisting of FIGS. 2A, 2B and 2C, shows three examples of time signals reflecting the letter "a"
Figure 2B:
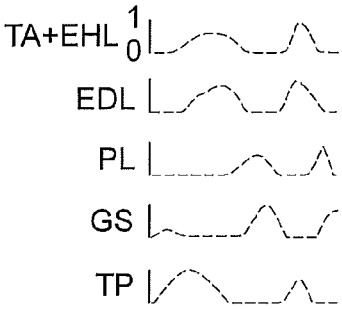
Figure 2C:
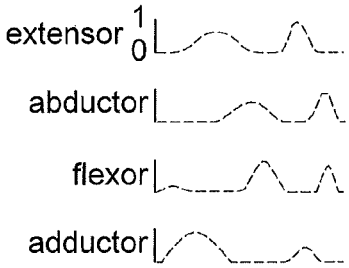
Figure 3A:
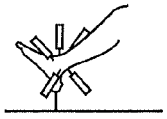
FIG. 3, consisting of FIGS. 3A, 3B and 3C, shows a joint under consideration for a subject for respectively FIGS. 2A to 2C.
Figure 3B:
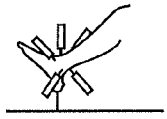
Figure 3C:
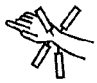
Figure 4A:
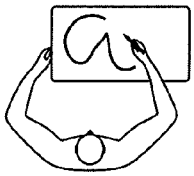
FIG. 4, consisting of FIGS. 4A, 4B and 4C, is the handwriting of the letter "a" above, corresponding respectively to FIGS. 3A to 3C.

The subjects were seated on a chair, holding a pencil in the hand (FIG. 4). FIGS. 3A and 3B show that one of their ankles was maintained at a right angle to the tibia, with P1=5 vibrators 61 on the tendons 2 under a pressure of about 0.5 N. In FIG. 3C it is a wrist which is coupled to P1=4 vibrators 61. The vibrators 61 were a product marketed by IKAR Co. Ltd under the commercial name Vibralgic model. The vibrators 61 had a head 1 to 2 cm long and 1 cm in diameter. It will be recalled that a vibrator 61 may be formed of a coil powered by the electric signal for the elementary pattern, amplified to the desired power, thereby producing an alternating magnetic field of a desired instantaneous amplitude and frequency and changing with time in order to produce the precise form of the elementary pattern. Each elementary pattern consisted of a series of 5 ms pulses, with a peak-to-peak amplitude of 0.25 mm. Their spectrum was in the band ranging from 1 to 100 Hertz. The vibrator 61 may also be formed from a rotating electric motor rotor coupled to an eccentric mass. One can yet again provide a piezoelectric element. FIG. 2A thus shows a macro-pattern of five temporal patterns initially picked up on a subject when imposing on the ankle joint of the latter movement that matches the trace of the letter "a" through the end of the segment corresponding to this joint (dataset 11) and retranscribed in macro-pattern 31 in the memory 30, these elementary patterns cooperating to describe the neuro-sensory trace of the letter "a" through the sequencer 33 and the vibrators 61.

Figure 4B:
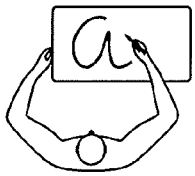
Figure 4C:
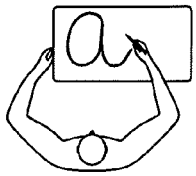

In the case of FIGS. 2B-2C and 3B-3C, we are dealing with a synthesis approach, in which a suitable set of elementary patterns was developed, that is to say that we chose those tendons 2 that it was appropriate to excite, and it was determined again, without the use of the experimental observations, what the temporal shape of each elementary pattern signals needed to be in order for the subject to best perceive a path determined as "correct" that is to say reproduces it, this respectively for the excitation of the ankle (FIG. 4B) or wrist (FIG. 4C). FIG. 4B shows how it was possible to improve the natural signals (FIG. 2A) in order to obtain a perfect trace of the letter "a", thus indicating the desired perception to achieve this result. This is consequently a correction of a distortion of perception shown in FIG. 4A. The transcoder 20 can thus perform the inverse correction of the above distortion.

Figure 5:
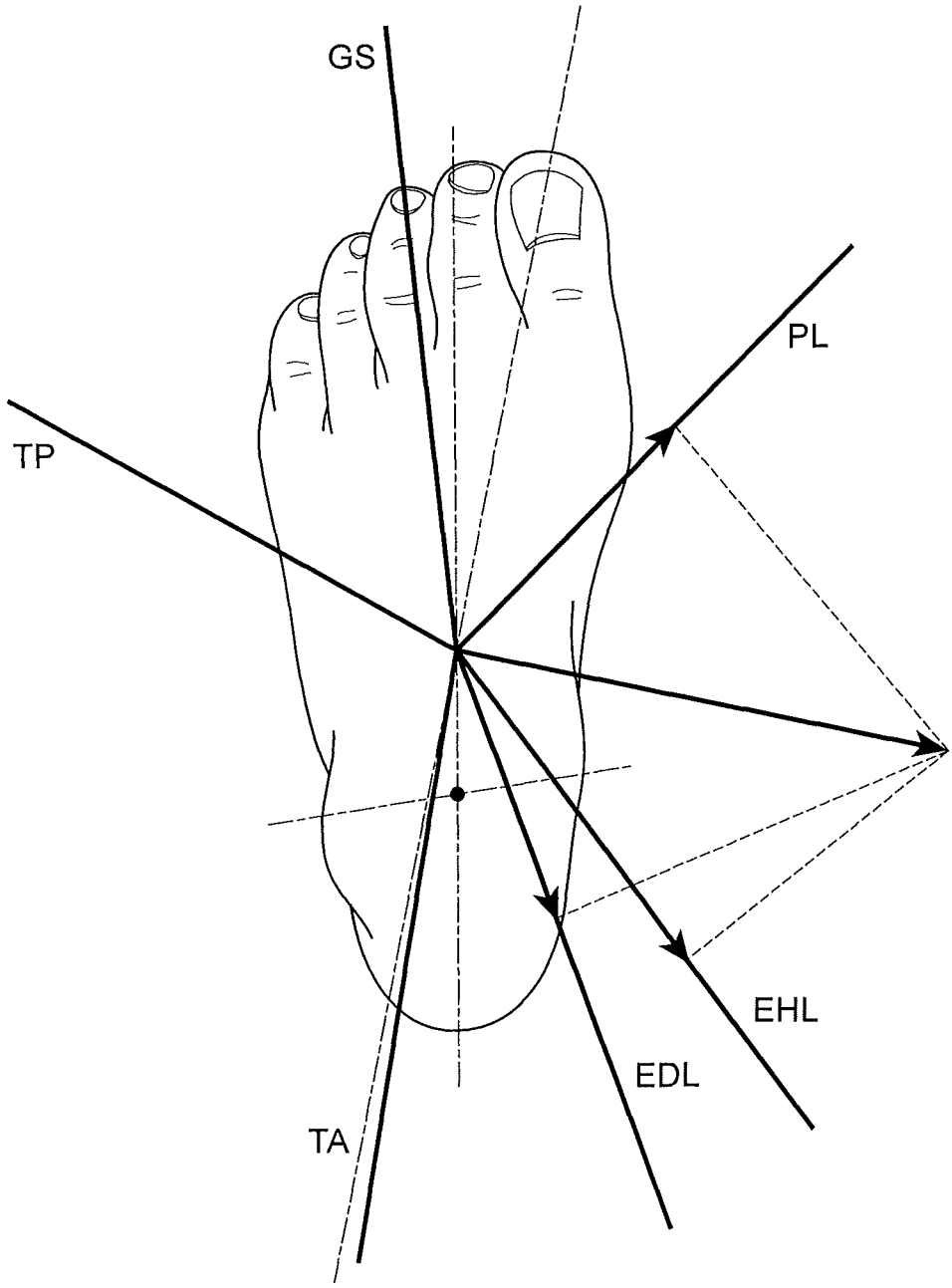
FIG. 5 shows a foot associated with various directions of sensation evoked by the vibration of various tendons.

FIG. 5 shows a top view of the foot, with various vectors representing the various excitations TA+EHL, EDL, PL, GS and TP in FIG. 2. To develop an artificial or synthetic macro-pattern 38, 39, a low pass filter was used to smooth the recordings of the paths followed. Moreover, the components of angular velocity of the path for writing the letter or digit in question, as orthogonal coordinates on the x-axis and y-axis were determined To do this, we determine, at eight fixed rate, every 200 ms, the difference in positions $\Delta x$ and $\Delta y$ of a current point in the writing path on the two axes, which supplied the direction and magnitude of an instantaneous velocity vector. A comparison between two such successive vectors then supplies an angle of deflection of the trajectory, having a bijective relationship with a certain curvature. According to this, the velocity vectors show progressive changes in their norm and therefore the structure of the artificial patterns is changing in the same way.

It is therefore designed for the ankle to receive various vectorial vibrations and therefore detect any change in direction of at least one of these. Regarding the sensitivity of such detection, we can define for each muscle, a direction of maximum sensitivity, that is to say that a given vibration will be perceived as attenuated if it has an oblique direction relative to the direction of maximum sensitivity. If we move away angularly from the direction of maximum sensitivity, the excitation of the vibrators 61 should be multiplied by the cosine of the angle of obliquity then existing. Such a method for drawing up macro-pattern for synthesis excitation of vibrators is applicable to any joint in the body of a living being.

FIGS. 6 and 7, similar to FIG. 2, each show five signals for the elementary pattern of five tendons 2, respectively for the letter "a" and the digit 8. For each elementary signal, it is shown, over 6.5 seconds, variations in signal frequency versus time, this frequency being normalized between 0 and 1, between the said lower limit of 1 Hz and the upper limit of 100 Hz. Each signal is in fact shown twice, firstly as a natural, experimental pattern (dashed line) determined from results obtained on the subject, and, additionally, as an artificial pattern (solid line), that is to say, generated while developing an artificial macro-pattern 38 or 39. The differences observed between the two signals of each pair are minor, that is to say they are not significant.

FIG. 8A shows eight paths with trajectories imposed for the four digits 1, 2, 3, 8 and the four letters a, b, e, n. FIG. 8B shows the corresponding traces reproduced experimentally as discussed in relation with FIGS. 2A, 3A and 4A, while FIGS. 8C and 8D correspond to the conditions discussed respectively in relation with FIGS. 2B, 3B, 4B and 2C, 3C, 4C, that is to say for the ankle or wrist.

The invention claimed is:

1. A method for generating a macro-pattern having a plurality of elementary excitation signals that induces bioelectric signals in a human body causing a human being to perceive sensations of a virtual movement of a body part when the plurality of elementary excitation signals are supplied to a plurality of vibrators disposed at predetermined positions arranged along subparts of the body part, the method comprising the steps of:

a) determining in advance the macro-pattern corresponding to the virtual movement of the body part of the human being;

b) applying vibrations corresponding to the plurality of elementary excitation signals of the macro-pattern to the predetermined positions arranged along the subparts of the body part of the human being;

c) collecting sensation indications from the human being that are indicative of the virtual movement perceived by the human being in response to step b);

d) iterating steps b) and c) while varying parameters of the macro-pattern in response to the sensation indications collected in accordance with step c) until the collected sensation indications correspond to a satisfactory sensation perception of the virtual movement.

2. The method according to claim 1, wherein the subparts of the body part that receive the plurality of vibrators are tendons belonging to muscles that are involved when the body part executes a real movement corresponding to the virtual movement, the tendons being mechanically stimulated by the plurality of vibrators supplied with the plurality of elementary excitation signals of the macro-pattern.

3. The method according to claim 2, wherein the parameters that are varied in accordance with step d) comprise at least one of the following:

a frequency change to the plurality of elementary excitation signals;

an amplitude change to the plurality of elementary excitation signals; and an amplitude and frequency change to the plurality of elementary excitation signals.

4. The method according to claim 1, wherein the macro-pattern is determined in step a) as a result of the plurality of elementary excitation signals each being picked up in a nerve close to sensory fibers originating from physiological receptors of the body part of the human being executing a real movement of the body part corresponding to the virtual movement.

5. A method for generating a macro-pattern having a plurality of elementary excitation signals that induces bioelectric signals in a body of a living being causing the living being to perceive sensations of a virtual movement of a body part when the plurality of elementary excitation signals are supplied to a plurality of vibrators disposed at predetermined positions arranged along subparts of the body part, the method comprising the steps of:

a) determining instantaneous velocity vectors following a given path of points spaced in time that corresponds to the virtual movement;

b) identifying muscles of the living being that would be involved if the living being performed with the body part an actual movement corresponding to the virtual movement;

c) identifying for the muscles identified in accordance with step b) directions of maximum sensitivity for sending bioelectric signals to a brain of the living being in response to actual movements of the body part; and d) establishing the macro-pattern by characterizing the plurality of elementary excitation signals from an analysis of the instantaneous velocity vectors relative to the directions of maximum sensitivity of the muscles.

6. The method of claim 5, wherein the given path is recorded and smoothed by using a low-pass filter and wherein the determination of the velocity vectors is performed for equally spaced points in time.

7. The method according to claim 5, further comprising the steps of:

e) setting a respective frequency of the plurality of elementary excitation signals to a maximum excitation frequency for each vibrator of the plurality of vibrators when the instantaneous velocity vectors are oriented along the direction of maximum sensitivity of each respective muscle of the muscles identified in accordance with step b), and f) setting a respective frequency of the plurality of elementary excitation signals to an excitation frequency that becomes smaller and smaller as an orientation of the instantaneous velocity vectors moves away from the direction of maximum sensitivity of the respective muscle under consideration until a minimum value of excitation of the plurality of vibrators is reached.

8. The method according to claim 7, wherein the maximum excitation frequency is set to 100 Hz.

9. The method according to claim 7, wherein the respective frequency of the plurality of elementary excitation signals with respect to the maximum excitation frequency is determined as a function of the cosine of an angle between the instantaneous velocity vectors and the direction of maximum sensitivity of the respective muscle under consideration.

10. The method according to claim 5, wherein the plurality of elementary excitation signals have an amplitude that is set at a predetermined value.

11. The method according to claim 10, wherein the macro-patterns is generated by characterizing a frequency of the plurality of elementary excitation signals from analysis of the instantaneous velocity vectors relative to the directions of maximum sensitivity of the muscles.

12. The method according to claim 5, wherein the instantaneous velocity vectors are determined and the directions of maximum sensitivity of the muscles are represented in a common reference system.

13. The method according to claim 12, wherein the common reference system is an orthogonal coordinate system.

14. The method according to claim 12, wherein the virtual movement corresponds to an actual movement of the body part of the living being, the performance of which involves a single joint of the body.

15. The method according to claim 14, wherein the common reference system is centered on the single joint and is a system of orthonormal axes.

16. The method according to claim 14, wherein the common reference system is centered on a segment end of the body part that moves along the given path.

17. The method according to claim 5, wherein the given path is two-dimensional.

18. The method according to claim 5, wherein the given path is three-dimensional.

19. A method for generating a macro-pattern having a plurality of elementary excitation signals that induces bioelectric signals in a body of a living being causing the living being to perceive sensations of a virtual movement of a body part when the plurality of elementary excitation signals are supplied to at least one vibrator disposed at a predetermined position arranged along subparts of the body part, the method comprising the steps of:

a) determining instantaneous velocity vectors following a given path of points spaced in time that correspond to the virtual movement;

b) identifying muscles of the living being that would be involved if the living being performed with the body part an actual movement corresponding to the virtual movement;

c) identifying for the muscles identified in accordance with step b) directions of maximum sensitivity for sending bioelectric signals to a brain of the living being in response to actual movements of the body part; and d) establishing the macro-pattern by characterizing the plurality of elementary excitation signals from an analysis of the instantaneous velocity vectors relative to the directions of maximum sensitivity of the muscles;

e) setting a respective frequency of the plurality of elementary excitation signals to a maximum excitation frequency for vibrations applied to the body part by the at least one vibrator when the instantaneous velocity vectors are oriented along the direction of maximum sensitivity of each respective muscle of the muscles identified in accordance with step b); and f) setting a respective frequency of the plurality of elementary excitation signals to an excitation frequency that becomes smaller and smaller as an orientation of the instantaneous velocity vectors moves away from the direction of maximum sensitivity of the respective muscle under consideration until a minimum value of excitation of the vibrations is reached.

* * * * *

UNITED STATES PATENT AND TRADEMARK OFFICE

CERTIFICATE OF CORRECTION

PATENT NO. : 8,956,312 B2
APPLICATION NO. : 12/988830
DATED : February 17, 2015
INVENTOR(S) : Jean-Pierre Roll It is certified that error appears in the above-identified patent and that said Letters Patent is hereby corrected as shown below:

ON THE TITLE PAGE

Page 1, Column 1, Assignees, delete "Universite de Provence" and insert -- Université d'Aix-Marseille --.

Signed and Sealed this
Sixteenth Day of February, 2016

Michelle K. Lee

Michelle K. Lee
*Director of the United States Patent and Trademark Office*